US006706987B1

(12) United States Patent
Yoo

(10) Patent No.: US 6,706,987 B1
(45) Date of Patent: Mar. 16, 2004

(54) ROTARY PUSH SWITCH

(76) Inventor: Cheol-Sang Yoo, 113-610, Hyundai-johap apt., Junggaebon-dong 577, nowon-ku, Seoul (KR)

( * ) Notice: Subject to any disclaimer, the term of this patent is extended or adjusted under 35 U.S.C. 154(b) by 0 days.

(21) Appl. No.: 10/427,468

(22) Filed: May 1, 2003

(51) Int. Cl.[7] ..... H01H 3/32
(52) U.S. Cl. ..... 200/529; 200/523; 200/526
(58) Field of Search ..... 200/520, 523, 200/526–529

(56) References Cited

U.S. PATENT DOCUMENTS 4,891,476 A * 1/1990 Nation et al. ..... 200/11 R
5,132,499 A * 7/1992 Valenzona et al. ..... 200/526
5,847,345 A * 12/1998 Harrison ..... 200/284
6,097,272 A * 8/2000 Grover et al. ..... 335/207
6,180,905 B1 * 1/2001 Pollock et al. ..... 200/527
6,191,376 B1 * 2/2001 Bartok ..... 200/529

* cited by examiner

*Primary Examiner*—Michael A. Friedhofer
(74) *Attorney, Agent, or Firm*—Ladas & Parry

(57) ABSTRACT

A rotary push switch has upper and lower housings locked together by protuberances along one housing in locking grooves along the other. A return spring and an actuator are in a carrier within the upper housing together with a push button and a movable terminal. A plurality of fixed terminals are integrally formed with the lower housing and soldering holes are formed through a bottom of the lower housing at positions corresponding to the fixed terminals so that a power line can be connected to the fixed terminals.

4 Claims, 5 Drawing Sheets

ROTARY PUSH SWITCH

BACKGROUND OF THE INVENTION

1. Field of the Invention

The present invention relates to a rotary push switch mainly used in a vehicle interior light, and more particularly to a rotary push switch in which its components are simply assembled so as to maximize its assembling efficiency and productivity, and which provides a firm contact between fixed terminals and a movable terminal, and various connections of wirings so as to maximize its convenience in use.

2. Description of the Related Art

Generally, a conventional push switch comprises in combination a push button, an actuator, a movable terminal, a carrier, and a plurality of fixed terminals, installed between an upper housing and a lower housing.

In such a conventional push switch, whenever the push button is pressed and then returned to its original position, the actuator installed under the push button is operated to serve as a cam mechanism so that the carrier is intermittently rotated together with the movable terminal and selectively contacts the plural fixed terminals installed below the movable terminal, thus allowing the push switch to be turned on/off.

Several types of the push switch are disclosed by U.S. Pat. No. 4,891,476, and Korean Utility Model Registration Publication Nos. 198345 and 207503 to the present inventor(s).

More specifically, the assembled structure of one of the above disclosed conventional push switches is obtained by assembling a push button, an actuator, a return spring, a movable terminal, and a carrier in sequence using an assembling hole provided with a guide groove and installed through an upper housing. In both the push button and the actuator, a sliding protuberance formed along each of their peripheral surfaces is inserted into the guide groove of the assembling hole, and simultaneously a driving cam and an interlocked cam with gearwheel shapes are interlocked so that they are simultaneously operated. In the actuator, the carrier obtained by assembling the movable terminal including a plurality of contact portions and the return spring is intermittently rotated by a user's pushing of the push button.

Further, a substrate provided with a plurality of fixed terminals is assembled below the movable terminal including a plurality of the contact portion into a lower housing. By the rotation of the movable terminal, the plural contact portions of the movable terminal selectively contact the plural fixed terminals, thus allowing the push switch to be turned on/off.

The upper and lower housings are fixed to each other by inserting assembling rods formed on one housing into assembling holes formed on the other housing and then thermally fusing protruded ends of the assembling rods.

Other types of the conventional push switch disclosed by U.S. Pat. No. 4,996,401, and Korean Utility Model Registration Publication Nos. 128963 and 126988 to the present inventors. Compared to the above types of the conventional push switch, each of these types of the conventional push switch comprise movable and fixed terminals having designated shapes being different from the former types. Here, the fixed terminals are inserted into the inner wall of a lower housing, and the movable terminal is in contact with or out of contact with the fixed terminals by the rotation of the movable terminal, thus allowing the push switch to be turned on/off. The essential operating structures of these push switches are the same as or similar to those of the former push switches.

However, the above-described various conventional push switches have several problems, as follows.

First, since the push button, the actuator, the return spring, the movable terminal, and the carrier are assembled into one unit using the assembling hole of the upper housing, that is, many components are simultaneously assembled, the assembling efficiency and productivity of the above conventional push switches are reduced.

Further, since many components are assembled into the upper housing as they are not fixed or supported to one another, when the obtained upper housing and another component (i.e., the lower housing) are assembled, it is difficult to maintain their assembled condition and the assembling process of the above conventional push switches is inconvenient.

Second, since the upper and lower housings are combined by inserting assembling rods formed in one housing into assembling holes formed in the other housing and thermally fusing protruded ends of the assembling rods, the upper and lower housings are fixed to each other via a series of assembling and thermal fusion processes, thus reducing the assembling efficiency of the above conventional push switches.

Particularly, since the thermal fusion process requires expert skill, such a thermal fusion process is prone to cause defects in assembling the above conventional push switches and the assembled conventional push switches cannot be separated into their individual components.

Third, a plurality of the fixed terminals (i.e., three terminals) are independently assembled into the lower housing, thus causing inconvenience in assembling the above conventional push switches.

In order to solve the above third problem, there is proposed a method in which a plurality of the fixed terminals are riveted on a separate substrate and then the substrate provided with the fixed terminals is assembled into the lower housing. However, this method requires a step for fixing the fixed terminals to the separate substrate, thus causing inconvenience in assembling the above conventional push switches.

Fourth, the above conventional push switches are limited in their method of connection to power. That is, a pin-type terminal connected to a power line is inserted into a connection portion at one end of each of the above fixed terminals.

Further, the connection portion includes a hole formed at the end of the fixed terminal and the terminal is tightly fitted with the hole, thus causing inconvenience in assembling the above conventional push switches. Particularly, in case the outer diameter of the terminal does not coincide with the inner diameter of the correspondent hole even if the difference between the diameters is very small, it is difficult to insert the terminal into the hole or even if possible, the terminal is easily released from the hole.

SUMMARY OF THE INVENTION

Therefore, the present invention has been made in view of the above problems, and it is an object of the present invention to provide a rotary push switch in which its components are simply assembled so as to maximize its assembling efficiency and productivity, and which provides a firm contact between a movable terminal and fixed terminals so as to maximize its reliability in use.

It is another object of the present invention to provide a rotary push switch which provides various connections of wirings so as to maximize its convenience in use.

In accordance with the present invention, the above and other objects can be accomplished by the provision of a rotary push switch formed in a built-up manner by assembling upper and lower housings by elastically inserting a plurality of locking protuberances formed along one housing into a plurality of locking grooves formed along the other housing, wherein: a return spring and an actuator are assembled in a carrier within the upper housing, a push button is inserted into an upper part of the carrier provided with the returning spring and actuator, and a movable terminal is inserted into a lower end of the carrier provided with the returning spring and actuator; and a plurality of fixed terminals are integrally formed with the lower housing and soldering holes are formed through a bottom of the lower housing at positions corresponding to the fixed terminals so that a power line is connected to the fixed terminals using terminals or by soldering.

BRIEF DESCRIPTION OF THE DRAWINGS

The above and other objects, features and other advantages of the present invention will be more clearly understood from the following detailed description taken in conjunction with the accompanying drawings, in which:

FIG. 5*a* is a perspective view of fixed terminals;

FIG. 5*b* is a plan view of the lower housing formed so that the fixed terminals are inserted into the lower housing; and FIG. 5*c* is a side view of the forming-finished lower housing.

FIG. 6*a* is a bottom view of a lower housing; and

FIG. 6*b* is a cross-sectional view of the lower housing.

DESCRIPTION OF THE PREFERRED EMBODIMENTS

Figure 1:
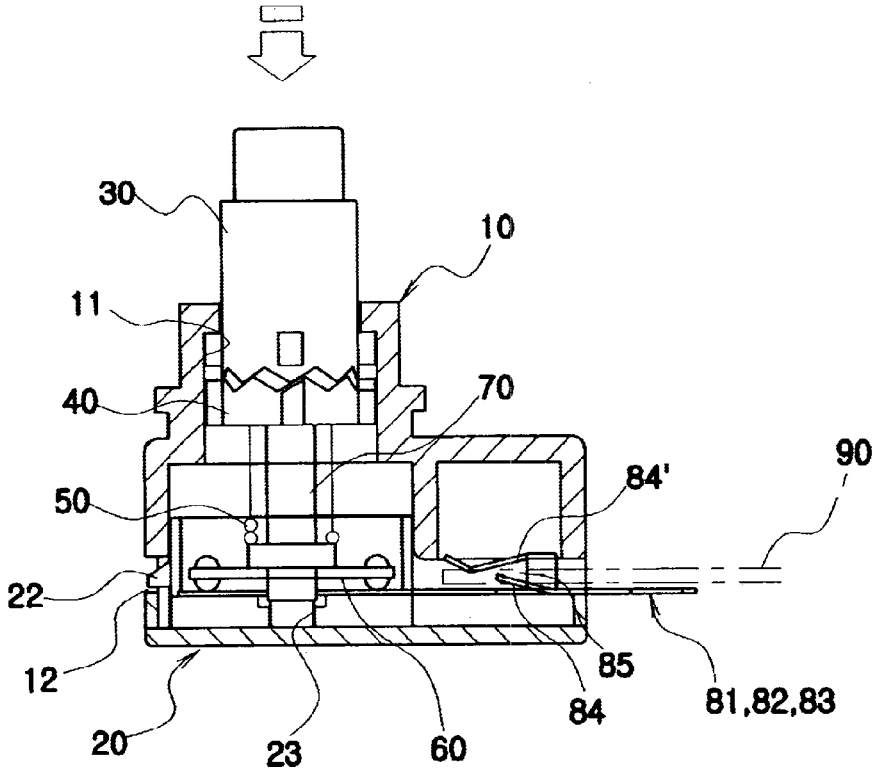
FIG. 1 is an assembled cross-sectional view of a rotary push switch in accordance with one embodiment of the present invention.
Figure 2:
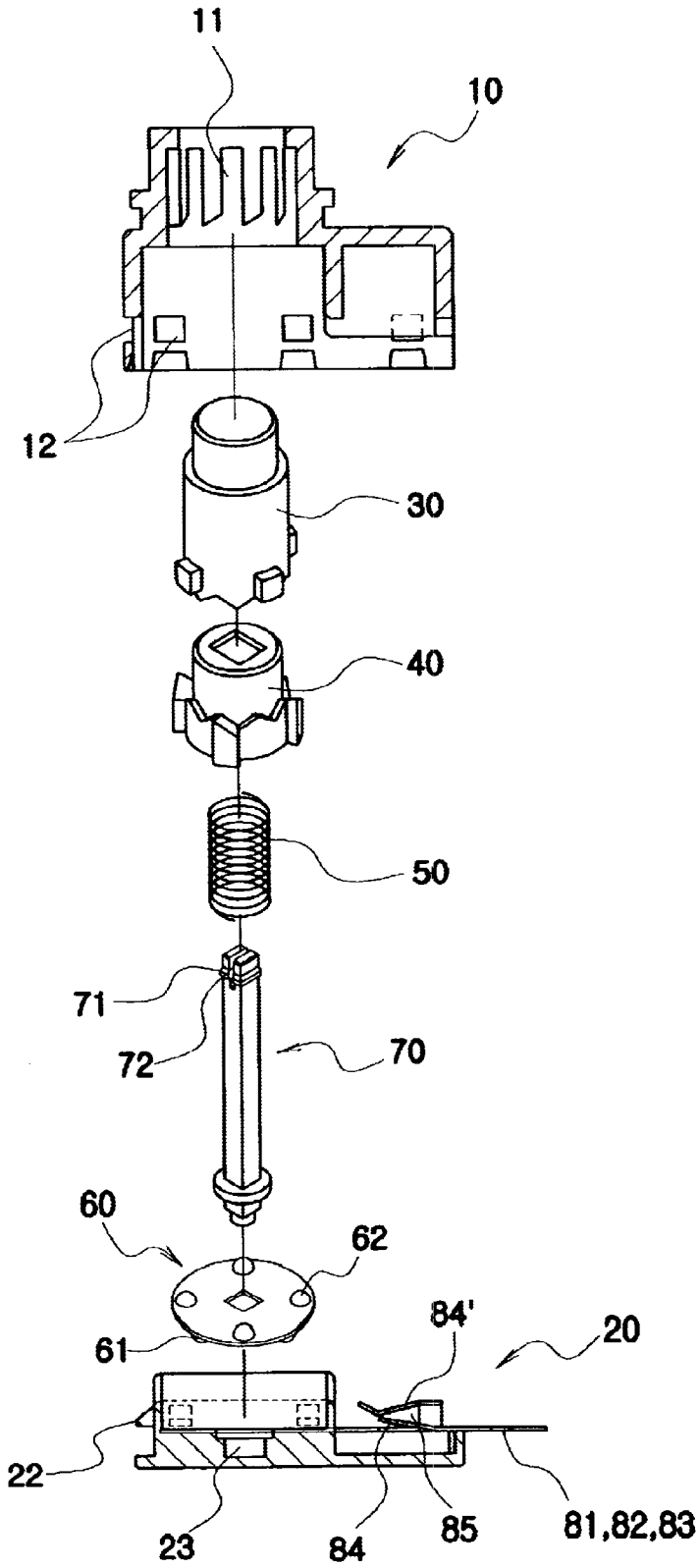
FIG. 2 is an exploded perspective view of the rotary push switch in accordance with one embodiment of the present invention.
Figure 3:
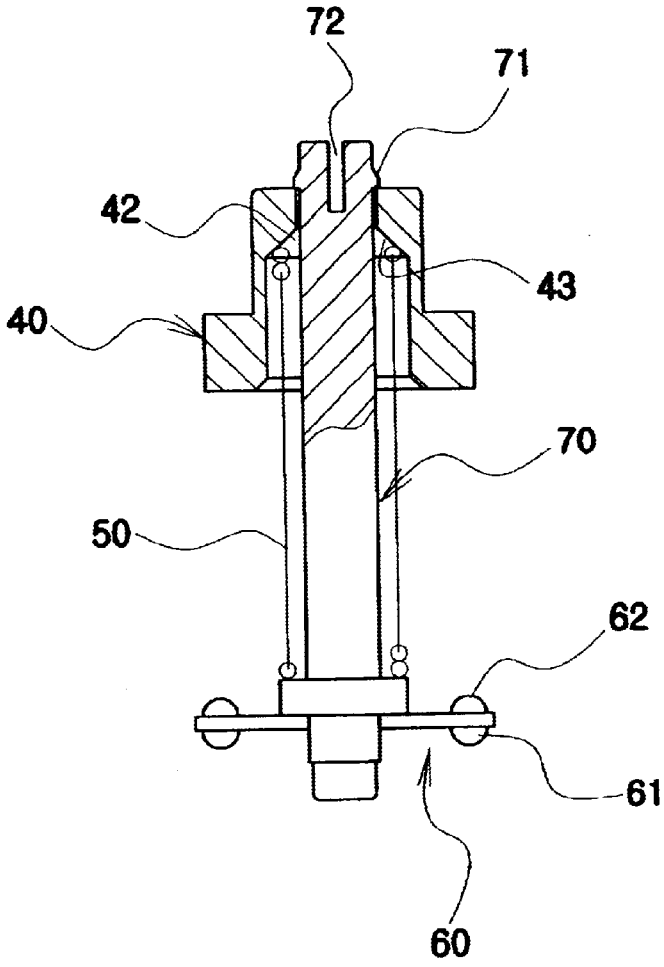
FIG. 3 is a cross-sectional view of an essential part of the rotary push switch in accordance with one embodiment of the present invention.
Figure 4:
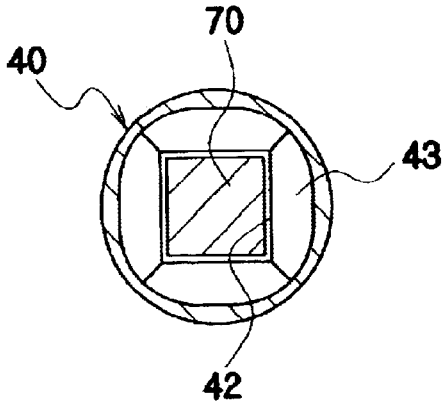
FIG. 4 is a plan view of FIG. 3.

Now, preferred embodiments of the present invention will be described in detail with reference to the annexed drawings.

As shown in FIGS. 1 to 5, a rotary push switch in accordance with one embodiment of the present invention is obtained by assembling upper and lower housings 10 and 20. A push button 30, an actuator 40, a return spring 50, and a movable terminal 60 are inserted into a carrier 70 within the upper housing 10 via an assembling hole 11 so that the push motion of the push button 30 is changed by the actuator 40 into intermittent rotary motions of the carrier 70 and the movable terminal 60, and a plurality of fixed terminals 81, 82, and 83 are mounted in the lower housing 20 so that ON and OFF positions of a contact between the fixed terminals 81, 82 and 83, and the movable terminal 60 are alternated by the rotation of the movable terminal 60.

Here, each of the plural fixed terminals 81, 82, and 83 includes a connection portion 85 and a filling hole 86. The connection portion 85 has upper and lower elastic sections 84 and 84', which are curved. The filling hole 86 serves to allow a liquefied resin to be fed therethrough, thus forming the lower housing 10 integrally with the fixed terminals 81, 82, and 83.

The carrier 70 includes a prominence 71 formed along an upper part of its outer circumference spaced from a flange 73 formed along a lower part of its outer circumference, and an elastic groove 72 formed through the upper part in a designated depth for allowing the upper part of the carrier 70 to be elastic so that the return spring 50 and the actuator 40 inserted into the carrier 70 are firmly fixed to the prominence 71 so as to prevent the return spring 50 and the actuator 40 from separating from the carrier 70, and then the push button 30 is assembled into the upper part of the carrier 70 and the moveable terminal 60 is assembled into the lower part of the carrier 70.

A plurality of locking grooves 12 are formed along the external surface of one housing of the upper and lower housings 10 and 20, and a plurality of locking protuberances 22 corresponding to the locking grooves 12 are formed along the external surface of the other housing of the upper and lower housings 10 and 20. Thus, the upper and lower housings 10 and 20 are combined with each other by elastically inserting the locking protuberances 22 into the corresponding locking grooves 12.

The actuator 40 includes an insertion hole 42 formed therein for allowing the carrier 70 with a rectangular cross-section to pass through the actuator 40 thereby. A tapered portion 43 having a hollow rectangular shape is formed at an entrance of the insertion hole 42 so that the carrier 70 is guided and inserted into the insertion hole 42 by the tapered portion 43.

The movable terminal 60 includes a plurality of upper and lower contact portions 61 and 62 protruding from its upper and lower surface so that the upper contact portions 61 on the upper surface alternate with the lower contact portions 62 on the lower surface, and the movable terminal 60 can be inserted into the carrier 70 at any surface thereof.

Although the number of the upper or lower contact portions 61 or 62 is four in the drawings of the present invention, the upper and lower contact portions 61 and 62 are not limited in their number. That is, the number of the upper or lower contact portions 61 or 62 may be three or another number.

Figure 6A:
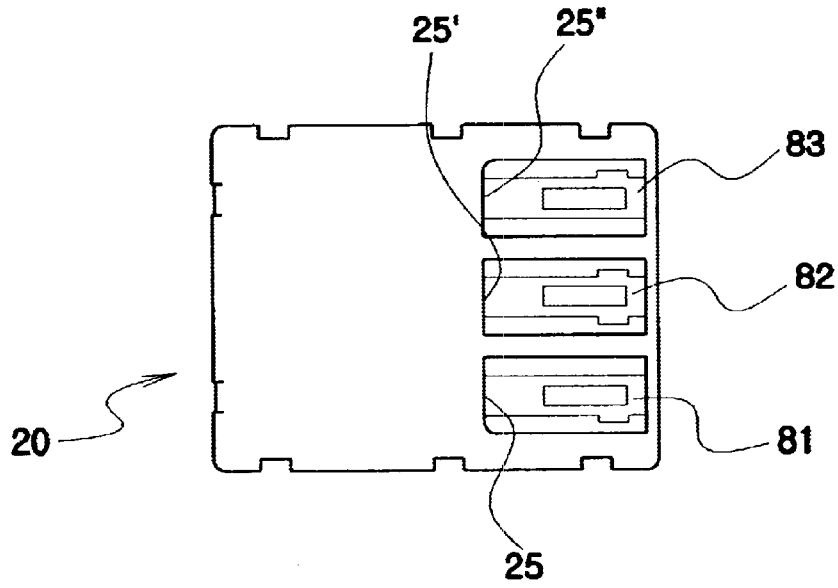
FIGS. 6*a* and 6*b* illustrate a rotary push switch in accordance with another embodiment of the present invention, and more particularly.
Figure 6B:
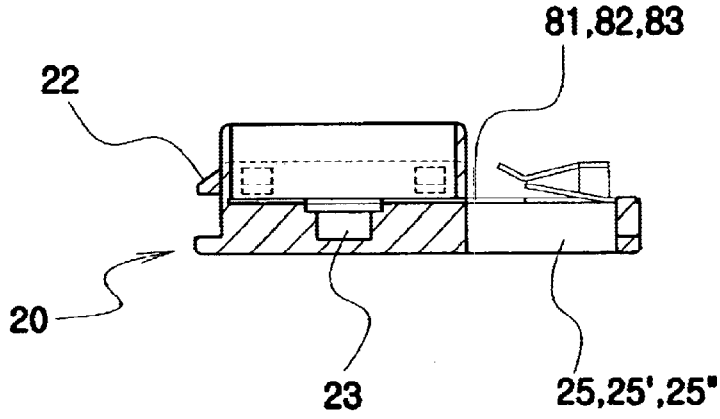

As shown in FIG. 6, the lower housing 20 includes soldering holes 25, 25' and 25" formed through its bottom at positions corresponding to the fixed terminals 81, 82, and 83 so that a power line is connected to the fixed terminals 81, 82, and 83 using terminals or by soldering.

Here, a non-described number 23 denotes an assembling hole formed through the lower housing 20 for receiving the carrier 70, and a non-described number 90 denotes a terminal.

Hereinafter, the operation and function of the rotary push switch in accordance with the preferred embodiment of the present invention is described in detail.

Figure 5A:
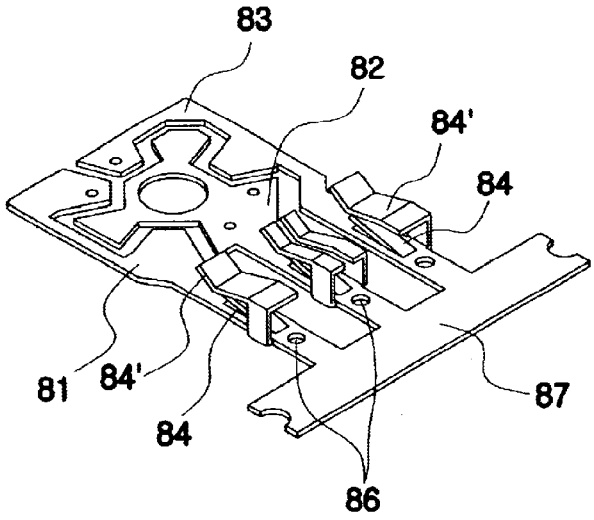
FIGS. 5*a*, 5*b*, and 5*c* illustrate a process for forming a lower housing of the rotary push switch in accordance with one embodiment of the present invention, and more particularly.
Figure 5B:
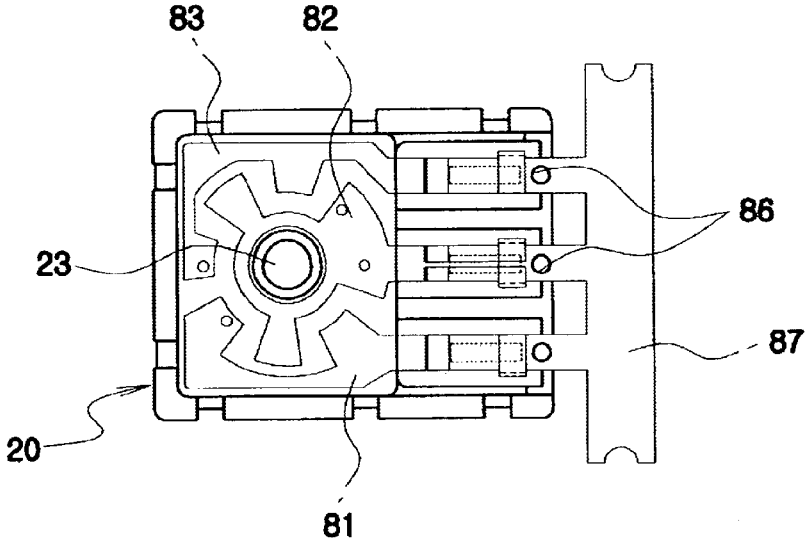
Figure 5C:
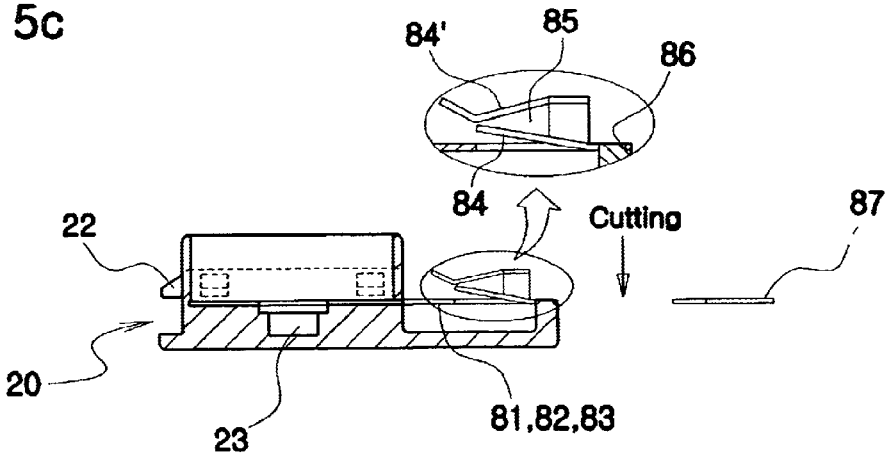

First, the lower housing 20 is integrally formed with the plural fixed terminals 81, 82, and 83. Accordingly, it is possible to minimize the number of components of the rotary push switch of the present invention. As shown in FIG. 5, the fixed terminals 81, 82, and 83, which are curved, are integrally formed by punching, and then a liquefied resin is fed into the fixed terminals 81, 82, and 83 via each filling holes 86, thus forming the lower housing 20 integrally with the fixed terminals 81, 82, and 83.

In this state, scrap portions 87 formed between the fixed terminals 81, 82, and 83 are cut away. Thereby, the lower housing 20 integrally formed with the fixed terminals 81, 82, and 83 is completely manufactured.

Next, the lower housing 20 integrally formed with the fixed terminals 81, 82, and 83, the upper housing 10, and other components are assembled.

More specifically, the push button 30, the actuator 40, the return spring 50, and the carrier 70 are assembled in sequence in the upper housing 10. Here, the actuator 40 and the return spring 50 are first assembled into the carrier 70, and then the carrier 70 provided with the actuator 40 and the return spring 50 is assembled in the upper housing 10.

That is, the return spring 50 and the actuator 40 are fixed to the prominence 71 formed along the upper part of the outer circumference of the carrier 70 so that the return spring 50 and the actuator 40 are prevented from separating from the carrier 70. Then, the carrier 70 provided with the return spring 50 and the actuator 40 fixed thereto is assembled in the upper housing 10. The push button 30 is fixed to the upper part of the carrier 70.

Further, the movable terminal 60 is fixed to the lower part of the carrier 70.

Accordingly, the rotary push button of the present invention is simply obtained by assembling five components such as the upper housing 10, the push button 30, the carrier 70 provided with the actuator 40 and the return spring 50, the movable terminal 60, and the lower housing 20.

Particularly, the actuator 40 and the return spring 50 are assembled in the carrier 70, and the carrier 70 provided with the actuator 40 and the return spring 50 is assembled with other components. Accordingly, it is possible to simplify the assembling process of the rotary push switch of the present invention compared to the conventional push switch, while maintaining its assembled state the same as the conventional push switch.

Further, in the rotary push switch in accordance with the present invention, the assembly of the components is simplified. Since the movable terminal 60 includes a plurality of the upper and lower contact portions 61 and 62 alternately protruding from its upper and lower surfaces, the movable terminal 60 can be inserted into the carrier 70 at any surface thereof.

That is, when the movable terminal 60 is inserted into the carrier 70 at the upper surface thereof, the upper contact portions 61 are used to contact the fixed terminals 81, 82, and 83. On the other hand, when the movable terminal 60 is inserted into the carrier 70 at the lower surface thereof, the lower contact portions 62 are used to contact the fixed terminals 81, 82, and 83.

Further, the tapered portion 43 having a hollow rectangular shape is formed at the entrance of the insertion hole 42 of the actuator 40. Thus, when the carrier 70 with a rectangular shape is inserted into the insertion hole 42, the carrier 70 is guided by the tapered portion 43 to be easily inserted into the insertion hole 42.

Moreover, the upper and lower housings 10 and 20 are simply combined with each other by elastically inserting a plurality of the locking protuberances 22 formed along the external surface of the lower housing 20 into a plurality of the locking grooves 12 formed along the external surface of the upper housing 10 at positions corresponding to the locking protuberances 22.

The upper and lower housings 10 and 20 are assembled by inserting the above locking protuberances 22 into the locking grooves 12 as well as using the conventionally employed thermal fusion method. Accordingly, in case that inner components of the upper and lower housings 10 and 20 are defective, it is possible to simply separate the upper and lower housings 10 and 20 from each other, thus being capable of replacing the defective inner components with new components and improving economic efficiency of the rotary push switch.

In order to supply power to the rotary push switch, the terminal 90 connected to a power line is inserted into the connection portions 85 of the fixed terminals 81, 82, and 83, each connection portion 85 including the upper and lower elastic sections 84 and 84'. Alternatively, a power line may be directly connected to the connection portions 85 of the fixed terminals 81, 82, and 38 by soldering via the soldering holes 25, 25', and 25" formed through the bottom of the lower housing 20.

Although the fixed terminals 81, 82, and 83 contact the movable terminal 60 in a vertical direction in the preferred embodiment of the present invention, the contact between the fixed terminals 81, 82 and 83, and the movable terminal 60 is not limited thereto, but may be variously modified. However, since the vertical contact between the fixed terminals 81, 82 and 83, and the movable terminal 60 is most excellent and stable, this type of the contact is described above.

Further, although the movable terminal 60 is installed at the lower part of the carrier 70 as shown in the drawings, the position of the movable terminal 60 is not limited thereto, but may be at the upper part of the carrier 70 so that the movable terminal 60 contacts the lower end of the return spring 50.

As apparent from the above description, the present invention provides a rotary push switch in which its components are simply assembled or partially integrally formed with each other, thus reducing the number of the components and improving the assembled structure of the components. Accordingly, it is possible to maximize the assembling efficiency and productivity of the rotary push switch and provide a firm contact between a movable terminal and fixed terminals.

Further, the rotary push switch of the present invention is connected to a power supply by various methods such as the use of terminals or a soldering method, thus maximizing its convenience in use.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A rotary push switch obtained by assembling upper and lower housings, in which a push button, an actuator, a return spring, and a movable terminal are inserted into a carrier within the upper housing via an assembling hole formed through the upper housing so that the push motion of the push button is changed by the actuator into intermittent rotary motions of the carrier and the movable terminal, and a plurality of fixed terminals are assembled in the lower housing so that ON and OFF positions of a contact between the fixed terminals and the movable terminal are alternated by the rotation of the movable terminal, wherein:

each of the plural fixed terminals includes a connection portion having upper and lower elastic sections, which are curved, and a filling hole serving to allow a liquefied resin to be fed therethrough so as to form the lower housing integrally with the fixed terminals;

the carrier includes a prominence formed along an upper part of an outer circumference spaced from a flange formed along a lower part of the outer circumference, and an elastic groove formed through the upper part in a designated depth for allowing the upper part of the carrier to be elastic so that the return spring and the actuator inserted into the carrier are firmly fixed to the prominence so as to prevent the return spring and the actuator from separating from the carrier, and then the push button is assembled into the upper part of the carrier and the moveable terminal is assembled into the lower part of the carrier; and a plurality of locking grooves are formed along the external surface of one housing of the upper and lower housings, and a plurality of locking protuberances corresponding to the locking grooves are formed along the external surface of the other housing of the upper and lower housings so that the upper and lower housings are combined with each other by elastically inserting the locking protuberances into the locking grooves.

2. The rotary push switch as set forth in claim 1, wherein the actuator includes an insertion hole formed therein for allowing the carrier with a rectangular cross-section to pass through the actuator thereby, and a tapered portion having a hollow rectangular shape is formed at an entrance of the insertion hole so that the carrier is guided and inserted into the insertion hole by the tapered portion.

3. The rotary push switch as set forth in claim 1, wherein the movable terminal includes a plurality of upper and lower contact portions protruding from the upper and lower surfaces so that the upper contact portions on the upper surface alternate with the lower contact portions on the lower surface and the movable terminal can be inserted into the carrier at any surface thereof.

4. The rotary push switch as set forth in claim 1, wherein the lower housing includes soldering holes formed through the bottom at positions corresponding to the fixed terminals so that a power line is connected to the fixed terminals using terminals or by soldering.

* * * * *